United States Patent [19]

Michaud et al.

[11] Patent Number: 4,491,500

[45] Date of Patent: Jan. 1, 1985

[54] METHOD FOR REFINEMENT OF METAL SURFACES

[75] Inventors: Mark D. Michaud; Robert G. Michaud, both of Bristol; Frank Tirendi, Hamden; Robert G. Zobbi, Southbury, all of Conn.

[73] Assignee: Rem Chemicals, Inc., Southington, Conn.

[21] Appl. No.: 581,420

[22] Filed: Feb. 17, 1984

[51] Int. Cl.[3] ..... C23F 1/00; C23F 5/02; C23C 1/10

[52] U.S. Cl. ..... 156/628; 148/6.14 A; 148/6.15 Z; 148/6.16; 148/6.2; 156/637; 156/645; 156/656; 156/664; 252/79.4

[58] Field of Search ..... 156/628, 637, 645, 656, 156/664, 665, 666, 903; 148/6.14 R, 6.14 A, 6.15 R, 6.15 Z, 6.16, 6.2; 252/79.2, 79.4, 79.3

[56] References Cited

U.S. PATENT DOCUMENTS

| | | |
|---|---|---|
| Re. 27,662 | 6/1973 | Hamilton et al. . |
| 2,298,418 | 10/1942 | Roesner et al. . |
| 2,663,928 | 12/1953 | Wheeler, Jr. . |
| 2,739,882 | 3/1956 | Ellis et al. . |
| 3,061,494 | 10/1962 | Snyder et al. . |
| 3,259,517 | 7/1966 | Atwell et al. . |
| 3,291,667 | 12/1966 | Young, Jr. et al. . |
| 3,373,113 | 3/1968 | Achenbach et al. . |
| 3,593,410 | 7/1971 | Taylor . |
| 3,635,826 | 1/1972 | Hamilton . |
| 3,650,861 | 3/1972 | Angell . |
| 3,654,001 | 4/1972 | Mann . |
| 3,719,536 | 3/1973 | Rheingold et al. . |
| 3,905,907 | 9/1975 | Shiga . |
| 3,932,243 | 1/1976 | Chang . |
| 3,979,858 | 9/1976 | Semones et al. . |
| 4,086,176 | 4/1978 | Ericson et al. . |
| 4,380,490 | 4/1983 | Aspnes et al. . |

OTHER PUBLICATIONS

Vibratory Finishing with Chemical Accelerators by W. H. Safranek and H. R. Miller, Jan. 1972.

*Primary Examiner*—William A. Powell

[57] ABSTRACT

Metal surfaces are refined, by the process of the invention, to high levels of smoothness in relatively short periods of time. A liquid substance is utilized to produce a conversion coating on the surface of the parts being treated, which are agitated, while being continuously wetted by the substance, in a mass finishing unit. Abrasive action causes the relatively soft coating to be removed from the high points of the surface, while leaving substantially intact the coating on the lower surface areas, with the coating being continuously repaired over metal exposed during operation. Fillage of the finishing unit container ensures efficient agitation and continuous oxygenation of the liquid substance, thereby maintaining a desirable rate of reaction and a high rate of surface leveling.

14 Claims, No Drawings

METHOD FOR REFINEMENT OF METAL SURFACES

BACKGROUND OF THE INVENTION

To a large extent, the quality of any electroplate produced upon a metal part will depend upon the nature of the underlying surface. Generally, it will be of utmost importance that any substrate that is to be electroplated with chromium, nickel, or the like, or provided with other types of decorative or protective coatings, be very smooth and substantially free from defects. Grinding and polishing equipment can be used for that purpose; however, only a limited degree of improvement can be achieved in that manner, and such operations tend to impregnate the surface with fine abrasive particles and other foreign matter, necessitating subsequent treatment by pickling or aggressive cleaning. Mass finishing equipment (e.g., vibratory machines, open and closed vented tumbling barrels, and the like) are widely used to improve the quality of metal surfaces, but conventional practices generally require unduly extended periods of time, and in some instances ultimate refinement is not feasible. Finally, chemical finishing techniques (such as etching or bright dipping) are also widely employed, but they characteristically remove excessive amounts of metal from the surface, which is undesirable for a number of evident reasons, particularly when it is necessary to maintain close tolerances in the part being treated.

It is common practice to facilitate the action of cutting tools by applying certain substances to the surface of the workpiece. For example, in U.S. Pat. No. 2,298,418, Roesner et al disclose that higher cutting speeds and greater cutting thicknesses can be achieved by use of chemical solutions, such as phosphates. As is well known to those skilled in the art, in such techniques it is the cutting tool, rather than the metal surface, that is conditioned by the chemical substance; the objective is of course to enable a maximum bite and cutting speed, to achieve a high rate of metal removal.

In U.S. Pat. No. 3,593,410, Taylor teaches a method for casting and finishing tools or dies, wherein male and female members are matched and fitted together to effect removal of protuberances. The die numbers are mounted in a vibrating machine, and are submerged in an active solution (e.g., of copper sulfate) to chemically alter the matching surfaces; abrasive grits or grains may be interposed.

Certain esterification reaction products of phosphoric acid are used by Chang et al, in accordance with U.S. Pat. No. 3,932,243, to micro-etch the surface of a metal article; treatment is carried out in a conventional barrel or vibratory finishing machine. Mass finishing equipment is also used in cooperation with a chemical accelerator solution by Semons et al, in U.S. Pat. No. 3,979,858, to shorten finishing time and provide a smooth uniform surface on castings. The chemical accelerator solution employed comprises a lower aliphatic acid, and is maintained in the pH range 1.1 to 1.9; abrasive media may be included in the chemical solution.

Illustrative of other U.S. patents relating to surface modification, generally by chemical means, of metal articles are the following: U.S. Pat. Nos. 2,663,928 to Wheeler; 2,739,822 to Ellis, Jr.; 3,061,494 to Snyder et al; 3,259,517 to Atwell; 3,291,667 to Young, Jr. et al; 3,373,113 to Achenbach; 3,635,826 (reissued as Re. 27,662) to Hamilton; 3,650,861 to Angell; 3,654,001 to Mann; 3,719,536 to Rheingold et al; 3,905,907 to Shiga; 4,086,176 to Ericson et al; and 4,380,490 to Aspnes et al. In an article entitled "Vibratory Finishing With Chemical Accelerators", Safranek et al teach vibratory finishing processes for salvaging defective zinc die castings, and/or for preparing castings for electroplating, wherein a bright-dipping solution of sodium bisulfate and sodium dichromate is employed. Ten-fold acceleration of the finishing time, and the attainment of high quality surfaces, are reported by the authors.

Despite the widespread activity directed to the provision of techniques for the improvement of metal surfaces, as exemplified above, a demand remains for a process by which high levels of surface refinement (i.e., leveling, burr removal, and radiusing or edge improvement) can be produced quickly and efficiently, and with a minimal amount of metal removal.

Thus, it is the broad object of the present invention to provide a novel process by which metal surfaces can be refined to a high degree of smoothness, in very brief periods of time and with a minimal amount of surface metal removal.

It is a more specific object of the invention to provide such a process wherein the time required for surface refinement is reduced by a factor of about 25 percent to as much as 80 percent, from traditional processes.

Even more particularly, it is an object of the invention to produce a metal surface having an arithmetic average (AA) roughness in the range of five to ten in a period of less than six, and preferably about two to four, hours on a workpiece having an initial roughness value that is in excess of 15 AA to as high as 70 AA.

Further objects of the invention are to provide a process by which the productivity of mass finishing equipment can be greatly increased, the cost of surface refinement can be reduced substantially, and the need for subsequent treatment, such as by pickling and aggressive cleaning, can be minimized or eliminated.

SUMMARY OF THE INVENTION

It has now been found that the foregoing and related objects of the invention are readily attained in a process wherein a mass of elements, comprised of a quantity of objects with hard metal surfaces of arithmetic average roughness value in excess of about 15, is introduced into the container of mass finishing equipment. The mass of elements is wet with a liquid substance capable of rapid reaction, under oxidizing conditions, to chemically convert the metal of the object surfaces to a stable film of substantially reduced hardness, and the mass is rapidly agitated, while maintaining the metal surfaces in a wetted condition with the liquid substance, to produce relative movement and abrasive contact among the elements thereof and to produce continuous oxygenation of the liquid substance. The reactivity of the liquid substance and the intensity of agitation of the mass are controlled to maintain the stable film on the metal surfaces at least at the level of visual perceptibility. Agitation is continued for a period sufficient to produce a finish of arthimetic average roughness less than about 14, and preferably less than about 10; thereafter, the objects will generally be treated to dissolve the stable film from the metal surfaces.

In the preferred embodiments of the process, the mass of elements introduced into the mass finishing equipment will include a quantity of abrasive finishing media, and the agitation step will be carried out for a period of less than six hours. Generally, the surfaces will be of a metal selected from the group consisting of iron, copper, zinc, aluminum, titanium, and the alloys thereof, and the stable film will comprise an oxide, phosphate, oxalate, sulfate, and/or chromate of the substrate metal. Thus, the liquid substance utilzed to chemically convert the metal of the object surfaces will usually be a solution containing one or more of the radicals: phosphate, oxalate, sulfate, chromate, and mixtures thereof, and in certain instances it will be preferred for the substance to additionally include an oxidizing agent; generally, the liquid substance will have an acidic pH value. Solutions containing phosphate and oxalate radicals in combination with a peroxide compound are often found to be particularly effective for refining ferrous metal surfaces, and may be produced from a tripolyphosphate salt, oxalic acid, and hydrogen peroxide.

DETAILED DESCRIPTION OF THE PREFERRED EMBODIMENTS

As will be appreciated by those skilled in the art, virtually any type of mass finishing equipment can be utilized in the practice of the instant process. Most generally, vibratory equipment will be used, but open tumbling barrel equipment, vented closed tumbling barrel equipment, and centrifugal finishing equipment can also be employed, if so desired. The equipment is operated in a normal manner, and abrasive media may or may not be added, depending upon the nature of the metal workpieces and the results desired. It should be understood that, as used herein, the term "mass of elements" encompasses both the metal surfaced objects that are to be treated, and also any abrasive mass finishing media that is employed. As is well known, typical media include quartz, granite, natural and synthetic aluminim oxides, silicon carbide and iron oxides, which may be held within a matrix, such as of porcelain, plastic, or the like. In the normal practice of the invention, a metal casting or forging will first be subjected to a coarse finishing operations, such as by grinding or belting to a 150 grit finish, and ferrous metal parts will normally be descaled and rinsed prior to treatment in accordance with the present process.

Traditionally, compositions used in prior art processes carried out with mass finishing equipment were intended either to provide lubricity, such as in the cutting operations described in the above-identified patent to Roesner, or to prevent redeposition of particles ground from the part or disloged from the abrasive medium. The present process, on the other hand, is believed to be unique in its reliance upon a chemical substance that is capable of converting the metal of the substrate to a composition of reduced hardness, which composition exists on the substrate as a physically and chemically stable and visually perceptible film.

The high levels of effectiveness with which the process produces smooth and substantially defect-free surfaces is evidently attributable to the selective removal of high points, in the form of relatively soft chemical conversion compounds of the metal. Thus, although the entire surface will quickly become covered with a layer or film of the conversion coating, upon initial treatment with the chemical substance, the abrasive action of the parts upon one another, with or without any abrasive media used, will tend to remove only the more elevated portions of the substrate, leaving the depressed areas of the coating intact. By constantly wetting the metal surface with the chemical substance, the stable coating will continuously repair itself, covering those areas where the bare underlying metal has been freshly exposed by abrasion, to provide a new layer of the relatively soft film. If that portion remains higher than the adjacent areas it will continue to be scoured away until any roughness has been virtually eliminated.

It is to be noted that the function of the chemical substance used in the practice of the present process is entirely distinct from that of a bright dip or etchant-type of solution. Such solutions uniformily dissolve metal from the entire surface of the workpiece; leveling therefore proceeds much less efficiently and with the removal of an excessive amount of surface metal.

Also, although the solutions utilized in the present process may provide some lubricity, that is incidental to their function and does not, in fact, assist in the achievement of the objectives of the invention. As indicated above, lubrication will facilitate cutting operations; however, it is contrary to the objectives herein sought to penetrate the surface any more deeply than is absolutely essential, since that would result in the removal of undue amounts of substrate material, in turn tending to frustrate achievement of the levels of refinement desired.

As to the requirement that the film produced be visually perceptible, this essentially serves as a practical way to ensure the effectiveness of the chemical substance. Thus, the inability to observe at least the effect of the treating substance (if not the substance itself) will constitute empirical evidence that the film is either of inadequate stability or inadequate thickness to enable the process to be carried out successfully.

The amount of liquid substance utilized will be only that which will maintain all surfaces of the treated parts in a wetted condition, so as to ensure continuous and virtually instantaneous repair of any coating area removed through the abrasive action. It is imperative that the volume of liquid used be substantially less than that which will submerge the mass of elements (when the equipment is still), since otherwise oxygenation of the chemical substance and metal surfaces will be inhibited, in turn substantially reducing the efficiency of metal conversion and ultimate refinement. Moreover, when vibratory mass finishing equipment is employed, overfilling of the parts container will seriously inhibit, or indeed preclude, vibration and relative movement adequate to produce the necessary abrasive action. Typically, the liquid substance will be provided in an amount sufficient to constitute only a reservoir at the bottom of the container, and will generally constitute about 15 to 25 percent of its total volume.

As will be evident to those skilled in the art, the amount of any abrasive media utilized will depend upon numerous factors, such as the surface character and composition of the parts being treated, the composition of the solution utilized for the conversion coating, temperatures of operation, the degree and rate of refinement to be achieved, etc. As noted above, operation may be carried out on a part-on-part basis, with or without the addition of powdered abrasives.

Although the properties exhibited by the conversion coating produced on the metal substrate are of crucial importance to the successful practice of the present process, the formulation of the liquid substance utilized to produce the coating is not. The composition must be capable of quickly and effectively producing, under the conditions of operation, relatively soft reaction products of the basis metal, and the coating must be substantially insoluble in the liquid medium so as to ensure that removal occurs primarily by scouring or abrasion, rather than by dissolution.

The liquid substance will generally consist of water and up to about 40 weight percent of active ingredients, comprised essentially the conversion chemicals but also optionally and desirably including an oxidizing agent, and in some instances a stabilizer and/or a wetting agent. It should be noted that the amount of the added ingredients may exceed the limits of solubility without adverse effect; indeed, the presence of an insoluble fraction may be beneficial from the standpoint of maintaining a supply of active ingredient for replenishment of the liquid substance during the course of operations.

In more specific terms, and depending upon the metal substrate involved, the active ingredients will typically constitute a phosphate salt or acid, or a mixture thereof with oxalic acid, sodium oxalate, or the like; mixtures with a sulfate, such as from sulfuric acid or sodium bicarbonate, or with a chromate, such as from chromic acid or sodium chromate, are also effective. In addition, each of the baths may include about 0.05 to 0.5 gram per liter of any of the various known activators or accelerators, such as zinc, magnesium and iron phosphates, as well as organic and inorganic oxidizers, such as the peroxides, meta-nitrobenzene, and the chlorate, chlorite, nitrate, and nitrite compounds. The oxidizer, if used, will generally be included in a minimum amount of 0.5, to as much as 30, percent, by weight of the total liquid substance, the preferred maximum amount generally being about 10 percent. While ratios and amounts may vary widely, it is important that concentrations of the ingredients employed not be excessive, since unduly high rates of reaction, and excessive metal removal, will tend to result.

Exemplary of the efficacy of the present process is the following Example.

EXAMPLE ONE

Part A

Using a four cubic foot vibratory finishing unit, a test solution illustrative of traditional practice is prepared, containing 4 ounces per gallon of a standard burnishing compound constituting an alkaline silicate and a wetting agent; the solution functions by suspending dirt and metal particles removed by abrasion, and by providing lubrication to the surface of the pieces being treated. Also included in the test solution is an abrasive media consisting of aluminum oxide in a ceramic matrix (about 20 percent loading of particles). The parts are of hardened steel, belted to a 150 grit finish, and operation is carried out at a temperature of about 90° to 110° Fahrenheit.

Table One below sets forth data developed during three repetitions of the test; time is in hours, surface finish (as determined by a "P-5" Hommel Tester) is AA roughness, and weight is in grams:

TABLE ONE

| Sample | Time | Starting Finish | Final Finish | Starting Weight | Final Weight | Weight Loss | Percent Weight Loss |
|---|---|---|---|---|---|---|---|
| 1 | 16 | 61 | 28 | 64.0577 | 64.0154 | 0.0423 | 0.067 |
| 2 | 24 | 65 | 25 | 63.8812 | 63.8172 | 0.0640 | 0.10 |
| 3 | 26 | 60 | 25 | 64.5673 | 64.4739 | 0.0934 | 0.15 |

From the foregoing data, it can be seen that, after a period of 24 hours, the maximum level of surface refinement utilizing the formulation described is attained. It should be appreciated that a final finish of 25 AA is not considered satisfactory for most subsequent plating operations; to be acceptable for bright nickel plating, for example, a maximum AA value of about 10 is desired.

Part B

The procedure of part A is repeated within the same temperature range, utilizing metal parts and abrasive media of the same type and quality, but substituting for the liquid substance utilized a solution capable of producing a stable, relatively soft coating, embodying the concepts of the present invention. More particularly, the liquid substance consists of 8 ounces, per gallon of water, of a mixture consisting of 15 percent of sodium tripolyphosphate and 85 percent oxalic acid, and 1.0 percent, based upon the total weight of the liquid substance, of a 35 percent aqueous solution of hydrogen peroxide containing a small amount of phosphorac acid stabilizer. Set forth in Table Two below are the results of tests carried out using several batches of parts:

TABLE TWO

| Sample | Time | Starting Finish | Final Finish | Starting Weight | Final Weight | Weight Loss | Percent Weight Loss |
|---|---|---|---|---|---|---|---|
| 1 | 1 | 60 | 14 | 67.9687 | 67.8545 | 0.1143 | 0.16 |
| 2 | 2 | 59 | 8 | 67.1723 | 66.9696 | 0.2021 | 0.32 |
| 3 | 3 | 63 | 6.5 | 61.6750 | 61.4100 | 0.2650 | 0.43 |
| 4 | 4 | 61 | 6 | 68.5489 | 68.1914 | 0.3575 | 0.52 |
| 5 | 5 | 62 | 5 | 65.9300 | 65.5157 | 0.4143 | 0.63 |
| 6 | 6 | 65 | 5 | 62.7378 | 62.2584 | 0.4794 | 0.76 |

From the foregoing, it can be seen that the surfaces of hardened steel parts, initially having a 59–65 AA roughness, are refined to a value of 5 AA in a period of approximately 5 hours. Results significantly better than those achieved in the tests carried out as Part A of this Example are realized, moreover, during the first hour of operation.

Part C

In accordance with the disclosure of the above-cited Taylor U.S. Pat. No. 3,593,410, and utilizing a copper immersion depositing solution described in the "Metal Finishing Guide Book And Directory" issue of 1983, page 464, an immersion deposit is produced on the same type of steel parts as are employed hereinabove. The immersion solution consists of 2.0 ounces per gallon of copper sulfate and 0.1 ounce per gallon of sulfuric acid; operation is carried out at room temperature. The results of three test runs are described in Table Three below:

TABLE THREE

| Sample | Time | Starting Finish | Final Finish | Starting Weight | Final Weight | Weight Loss | Percent Weight Loss |
|---|---|---|---|---|---|---|---|
| 1 | 4 | 61 | 81 | 70.1921 | 68.0765 | 2.1156 | 3.01 |
| 2 | 4 | 63 | 82 | 65.1473 | 68.1805 | 1.9668 | 3.02 |
| 3 | 4 | 65 | 79 | 63.1836 | 61.2113 | 1.9723 | 3.12 |

The tests are discontinued after four hours of operation because, as can be seen from the data set forth, excessive metal is removed with no significant surface refinement; pitting and degradation are observed, as indicated by the AA values set forth, and hydrogen embrittlement is believed to occur. Evidently, the solutions described for use in the Taylor patent are not suitable for the method of the present invention, due to the oxygenation that necessarily takes place.

Another liquid substance that is effective in the practice of the present invention is an aqueous solution of monosodium phosphate with a small amount of ammonium fluoride added; it is particularly useful for stainless steel parts, the fluoride serving to dissolve the natural oxide layer but being used in an amount carefully controlled to avoid substantial etching of the substrate. A mixture of sodium oxalate and meta-nitrobenzene in water is effective for use with zinc parts, and aqueous mixtures of equal amounts of sodium bisulfate and monosodium phosphate, and of 0.5 percent potassium dichromate and 99.5 percent potassium phosphate, are both effective for use with hardened steel objects, the latter composition of course being somewhat undesirable from the standpoint of the waste treatment operations that must be carried out prior to discharge.

Although temperatures will not generally be critical, it will be appreciated that they do have a substantial effect upon the rate of metal conversion; depending upon the strength of the liquid substance, temperatures ranging from ambient to about 150° Fahrenheit will normally be used as a practical matter, although higher temperatures of operation are certainly feasible. As mentioned above, the pH of the conversion coating formulation will generally be on the acid side, and preferably will be in the range of about 1.1 to 6.5. This will, however, also depend upon many factors, including the specific composition of the liquid substance, the metal surface being treated, etc. Finally, although it will generally be desirable to remove the conversion coating at the end of the mass finishing procedure, this will not always be so, since the coating may serve a desirable function as a protective barrier against corrosion, and may be painted, waxed, oiled, or otherwise treated for particular purposes, if desired.

Thus, it can be seen that the present invention provides a novel process by which metal surfaces can be refined to a high degree of smoothness, in relatively brief periods of time and with a minimal amount of surface metal removal. The time required for surface refinement by traditional means is reduced by a factor of about 25 percent to as much as 80 percent; in particular a surface having an arithmetic average roughness in the range of five to ten can be obtained in a period of about two to four hours on a workpiece having an initial roughness value of about 70 AA or higher. By the present process the productivity of mass finishing equipment can be greatly increased, and excellent levels of surface refinement can be achieved at lower cost than has heretofore been possible.

Having thus described the invention, what is claimed is:

1. In a process for refining hard metal surfaces, the steps comprising:

A. introducing into the container of a mass finishing unit a mass of elements comprised of a quantity of objects with hard metal surfaces having a finish of arithmetic average roughness in excess of about 15;

B. wetting said mass of elements with a liquid substance capable of reaction, under oxidizing conditions, to chemically convert the metal of said surfaces to a substantially stable film of substantially reduced hardness;

C. rapidly agitating said mass of elements while maintaining said surfaces in a wetted condition with said substance, said agitation producing relative movement and abrasive contact among said elements and producing continuous oxygenation of said liquid substance; and D. controlling the reactivity of said substance and the intensity of agitation of said mass so as to maintain said film on said metal surfaces at least at the level of visual perceptibility, said agitating step being continued to produce on said metal surfaces a finish of arithmetic average roughness value less than about 14.

2. The process of claim 1 wherein said mass of elements includes a quantity of mass finishing media.

3. The process of claim 1 wherein the metal of said object surfaces is selected from the group consisting of iron, copper, zinc, aluminum, titanium, and alloys thereof.

4. The process of claim 3 wherein said stable film is comprised of at least one compound of said metal selected from the class consisting of the oxides, phosphates, oxalates, sulfates, and chromates thereof.

5. The process of claim 1 wherein said liquid substance contains, as an active conversion coating ingredient, a radical selected from the group consisting of the phosphate, oxalate, sulfate, and chromate radicals, and mixtures thereof.

6. The process of claim 5 wherein said substance additionally includes about 0.5 to 30 percent, based upon the weight thereof, of an effective amount of oxidizing agent.

7. The process of claim 5 wherein said substance has a pH value of less than about 7.

8. The process of claim 1 wherein said liquid substance is provided in an amount equal to about 15 to 25 percent of the volume of said mass finishing unit container.

9. The process of claim 1 wherein said agitating step is continued for a period of less than about six hours.

10. The process of claim 1 wherein said arithmetic roughness value produced is less than about 10.

11. The process of claim 1 including the additional final step of removing said film from said metal surfaces.

12. The process of claim 1 wherein said liquid substance comprises, as active conversion coating ingredients, a mixture of a tripolyphosphate and oxalic acid.

13. The process of claim 12 wherein said mixture comprises about 15 percent by weight of said tripolyphosphate and 85 percent by weight of oxalic acid.

14. The process of claim 12 wherein said formulation additionally includes an oxidizing agent.

* * * * *